US011619222B2

(12) United States Patent
Al-Gouhi

(10) Patent No.: US 11,619,222 B2
(45) Date of Patent: Apr. 4, 2023

(54) DOWNHOLE PUMPING TOOLS

(71) Applicant: Saudi Arabian Oil Company, Dhahran (SA)

(72) Inventor: Alwaleed Abdullah Al-Gouhi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 110 days.

(21) Appl. No.: 17/140,009

(22) Filed: Jan. 1, 2021

(65) Prior Publication Data

US 2022/0213886 A1 Jul. 7, 2022

(51) Int. Cl.

| | |
|---|---|
| ***E21B 23/06*** | (2006.01) |
| ***E21B 33/127*** | (2006.01) |
| ***E21B 41/00*** | (2006.01) |
| ***E21B 43/12*** | (2006.01) |
| ***E21B 47/047*** | (2012.01) |
| ***F04B 17/03*** | (2006.01) |
| ***F04B 49/04*** | (2006.01) |

(52) U.S. Cl.

CPC ..... *F04B 49/04* (2013.01); *E21B 23/06* (2013.01); *E21B 33/127* (2013.01); *E21B 41/00* (2013.01); *E21B 43/128* (2013.01); *E21B 47/047* (2020.05); *F04B 17/03* (2013.01)

(58) Field of Classification Search

CPC .... E21B 23/06; E21B 33/1208; E21B 33/127; E21B 41/00; E21B 43/128; E21B 47/047; F04B 17/03; F04B 49/04

See application file for complete search history.

(56) References Cited

U.S. PATENT DOCUMENTS

| | | | | |
|---|---|---|---|---|
| 7,040,402 | B2 * | 5/2006 | Vercaemer | E21B 33/13 166/253.1 |
| 10,844,700 | B2 * | 11/2020 | Al-Gouhi | E21B 43/128 |
| 11,149,505 | B2 * | 10/2021 | Britton | E21B 47/047 |
| 2016/0168933 | A1 * | 6/2016 | Aktas | E21B 21/01 73/152.43 |
| 2017/0065984 | A1 * | 3/2017 | Behzad | B03D 1/028 |
| 2020/0003035 | A1 * | 1/2020 | Al-Gouhi | E21B 43/128 |
| 2021/0156244 | A1 * | 5/2021 | Hoeie | E21B 47/06 |

(Continued)

FOREIGN PATENT DOCUMENTS

| | | |
|---|---|---|
| EP | 0314249 | 5/1989 |
| FR | 2532369 A1 * | 3/1984 |

*Primary Examiner* — Daniel P Stephenson

(74) *Attorney, Agent, or Firm* — Fish & Richardson P.C.

(57) ABSTRACT

Methods, systems, and computer-readable medium to perform operations including: determining, based on at least one dimension of an annulus of a wellbore, a respective downhole position at which to position at least one of an upper sensor and a lower sensor of a downhole pumping tool that includes a pump; positioning the downhole pumping tool in the wellbore such that at least one of the upper sensor and the lower sensor are positioned at the respective downhole position; in response to the upper sensor detecting a first fluid level in the annulus, activating the pump so that the pump pumps fluid from the annulus into a tubing of the wellbore, where the tubing carries the fluid to the surface; and in response to the lower sensor detecting a second fluid level in the annulus, deactivating the pump, where the second fluid level is below the first fluid level.

20 Claims, 5 Drawing Sheets

(56) References Cited

U.S. PATENT DOCUMENTS

| | | | | |
|---|---|---|---|---|
| 2022/0196536 | A1* | 6/2022 | Galbreth | G01N 15/06 |
| 2022/0213768 | A1* | 7/2022 | Al-Gouhi | F04D 15/0218 |
| 2022/0213886 | A1* | 7/2022 | Al-Gouhi | E21B 33/1208 |
| 2022/0282615 | A1* | 9/2022 | Alghazali | E21B 47/117 |

* cited by examiner

DOWNHOLE PUMPING TOOLS

TECHNICAL FIELD

This description relates to downhole pumping tools.

BACKGROUND

The productivity index of a reservoir is a measure of the reservoir's potential or ability to produce hydrocarbons. A reservoir that has a low productivity index has low production potential or ability to produce hydrocarbons.

SUMMARY

In low productivity index reservoirs, fluids (for example, hydrocarbon fluids) take time to accumulate within wellbores. As result, in practice, pumps are not used in wellbores located in low productivity index reservoirs since pumps are susceptible to burning, for example, in scenarios where the fluid level is too low to be pumped. Instead, sucker rod or plunger lift technologies are used in these wellbores since such mechanical devices are not susceptible to burning. However, sucker rod or plunger lift technologies have depth limitations, and thus, cannot be used in wellbores that extend beyond a certain depth. Wellbores that extend beyond the depth limitations of sucker rod or plunger lift technologies are increasingly being used in practice. Therefore, an alternative for sucker rod or plunger lift technologies, particularly in low productivity index reservoirs, is desired.

This disclosure describes tools that enable using pumps, such as electrical submersible pumps, in low productivity index reservoirs. The tools can be deployed, for example, downhole in wellbores located in low productivity index reservoirs. In an embodiment, a downhole pumping tool includes a first packer, a second packer, a pump, a first sensor, and a second sensor. The first packer, the second packer, and a tubing of the wellbore form an annulus when engaged with a downhole casing of the wellbore. The pump defines an inlet from the annulus into the tubing, which can carry fluids to the surface. The first sensor and the second sensor are located along a side of the tubing and are longitudinally separated such that the first sensor is closer to the first packer than the second sensor, and the second sensor is closer to the pump than the first sensor. The first sensor is configured to activate the pump when fluid in the annulus reaches a first fluid level. The second sensor is configured to deactivate the pump when the fluid reaches a second fluid level that is below the first fluid level.

Aspects of the subject matter described in this specification may be embodied in methods that include the actions of: determining, based on at least one dimension of an annulus of a wellbore, a respective downhole position at which to position at least one of an upper sensor and a lower sensor of a downhole pumping tool that includes a pump; positioning the downhole pumping tool in the wellbore such that at least one of the upper sensor and the lower sensor are positioned at the respective downhole position; in response to the upper sensor detecting a first fluid level in the annulus, activating the pump so that the pump pumps fluid from the annulus into a tubing of the wellbore, where the tubing carries the fluid to the surface; and in response to the lower sensor detecting a second fluid level in the annulus, deactivating the pump, where the second fluid level is below the first fluid level.

The previously-described implementation is applicable using a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium. These and other embodiments may each optionally include one or more of the following features.

In some implementations, the actions further including affixing a first packer to a first outer surface of the tubing and a casing of the wellbore, where the first packer longitudinally closer to the first sensor than the second sensor; and affixing a second packer to a second outer surface of the tubing and the casing, where the first and second outer surfaces are on horizontally opposite sides of the tubing, and where the tubing, the first packer, the second packer form the annulus when engaged with the casing.

In some implementations, the upper and lower sensors are located between a first plurality of perforations in the casing and the first packer.

In some implementations, the first packer and the second packer are inflatable packers.

In some implementations, the tubing is a production string.

In some implementations, the downhole pumping tool further includes: a porous housing defining an inner volume; and a floatable object that floats on the fluid, wherein the floatable object, the first sensor, and the second sensor are located within the inner volume, and wherein the first sensor and the second sensor are configured to detect the floatable object.

In some implementations, the pump is an electric submersible pump.

The subject matter described in this specification can be implemented in particular implementations so as to realize one or more of the following advantages. The disclosed tools enable using pumps, such as electrical submersible pumps, in low productivity index reservoirs. In particular, the tools significantly reduce or eliminate the risk of pumps burning out, for example, in low productivity index reservoirs. Using the disclosed tools improves drilling operations and facilitates hydrocarbon exploration in formations that existing tools are not capable of exploring.

The details of one or more embodiments of these systems and methods are set forth in the accompanying drawings and the description below. Other features, objects, and advantages of these systems and methods will be apparent from the description and drawings, and from the claims.

DETAILED DESCRIPTION

The present disclosure describes a downhole pumping tool that is operable to pump a fluid from a subterranean zone to the surface. The tool includes tubular conduits affixed to each other and positioned in a wellbore. Further, the tool includes wellbore seals that help form an annulus in the wellbore. Hydrocarbon fluid from the subterranean zone collects in the annulus. When the hydrocarbon fluid level reaches a first predefined level, a pump pumps the hydrocarbon fluid from the annulus into the tubular conduit. Then, when the hydrocarbon fluid level falls to a second predefined level, the pumps stops pumping the hydrocarbon fluid. By operating as such, the tool avoids scenarios where the fluid level is too low to pump, which can result in the pump burning.

Figure 1:
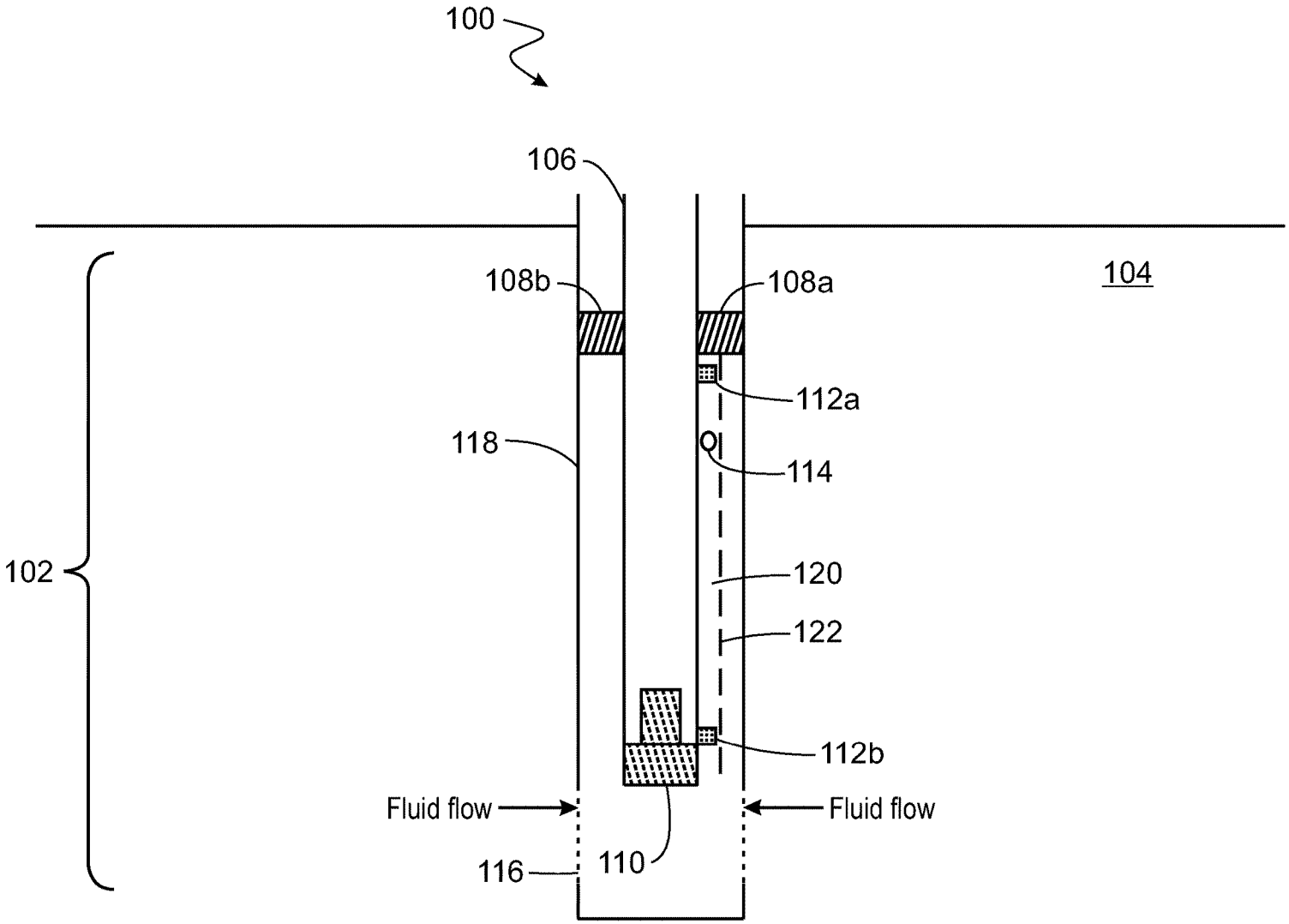
FIG. 1 is a schematic illustration an example wellbore system that includes a downhole pumping tool, according to some implementations of the present disclosure.

FIG. 1 is a schematic illustration of an example wellbore system 100 that includes a downhole pumping tool 102, according to some implementations. More specifically, FIG. 1 illustrates the downhole pumping tool 102 disposed in a wellbore located in a formation 104. In this arrangement, the downhole pumping tool 102 receives a hydrocarbon fluid (for example, oil) from the formation 104 through perforations 116 in a casing 118 of the wellbore. The downhole pumping tool 102 directs the flow of the hydrocarbon fluid into an annulus formed in the wellbore system 100. The hydrocarbon fluid then accumulates in the annulus.

In an embodiment, the wellbore system 100 includes a downhole conveyance that is operable to convey (for example, run in) the downhole pumping tool 102 into the wellbore. Although not shown, a drilling assembly deployed on the surface may form the wellbore prior to running the downhole pumping tool 102 into the wellbore. In some embodiments, the wellbore system 100 extends from the surface and through one or more geological formations in the Earth including the formation 104. The formation 104 includes a hydrocarbon fluid zone and is located under the surface. As explained in more detail below, one or more wellbore casings, such as the casing 118, can be installed in at least a portion of the wellbore.

In some embodiments, the wellbore system 100 is deployed on a body of water rather than a terranean surface. In these embodiments, the surface may be an ocean, gulf, sea, or any other body of water under which hydrocarbon-bearing formations can be found. In short, reference to "a surface" includes both land and water surfaces and contemplates forming and developing one or more wellbore systems 100 from either or both locations.

In some embodiments, the downhole conveyance includes a tubular production string made up of multiple tubing joints. As an example, a tubular production string (also known as a production casing) includes sections of steel pipe, which are threaded so that they can interlock together. As shown in FIG. 1, the wellbore system 100 includes tubing 106. As another example, the downhole conveyance includes coiled tubing. As yet another example, a wireline or slickline conveyance (not shown) is communicably coupled to the downhole pumping tool 102.

In some embodiments, the wellbore is cased with one or more casings such as casing 118. In some examples, the wellbore is from vertical (for example, a slant wellbore). In other examples, the wellbore is a stepped wellbore, such that a portion is drilled vertically downward and then curved to a substantially horizontal wellbore portion. Additional substantially vertical and horizontal wellbore portions can be added according to, for example, the type of surface, the depth of one or more target subterranean formations, the depth of one or more productive subterranean formations, or other criteria. As shown in FIG. 1, the casing 118 includes perforations 116 through which hydrocarbon fluid flows from the formation 104 into an annulus 120.

In some embodiments, the downhole pumping tool 102 includes an electric submersible pump (ESP) 110, an upper sensor 112*a*, a lower sensor 112*b*, a first seal 108*a*, and a second seal 108*b*. The tubing 106 includes a lower vertical opening in which the ESP 110 is disposed. The first seal 108*a* and the second seal 108*b* are configured to form a seal between the tubing 106 and the casing 118. As shown in FIG. 1, the first seal 108*a* is affixed to a first outer surface of the tubing 106 and the second seal 108*b* is affixed to a second outer surface of the tubing 106, where the first and the second outer surfaces are on horizontally opposite sides of the tubing 106. In some implementations, the first seal 108*a* and the second seal 108*b* are packers, for example, inflatable packers or mechanical packers. When sealed, the first seal 108*a*, the second seal 108*b*, the tubing 106, and the casing 118 form the annulus 120 that functions as a receptacle for hydrocarbon fluids.

The ESP 110 includes an inlet that faces a bottom surface of the annulus 120 and includes an outlet into the tubing 106. Thus, the ESP 110 forms a passage for hydrocarbon fluids to flow from the annulus 120 into the tubing 106 (and then to the surface). For example, the ESP 110 injects hydrocarbon fluids from the annulus 120 into the tubing 106. The ESP 110 is controlled based on a hydrocarbon fluid level in the annulus. More specifically, the upper sensor 112*a* and the lower sensor 112*b* detect the hydrocarbon fluid level and turn the ESP 110 on or off based on detected level. Within examples, the upper sensor 112*a* and the lower sensor 112*b* can be an image sensors, optical sensors, time-of-flight sensors, motion detectors, fluid level sensors, electromagnetic sensors, tactile sensors, or proximity sensors.

As shown in FIG. 1, the upper sensor 112*a* is located closer to the seal first 108*a* than the lower sensor 112*b*, and the lower sensor 112*b* is located closer to the ESP 110 than the upper sensor 112*a*. In an example arrangement, the upper sensor 112*a* and the lower sensor 112*b* are positioned on an outer surface of the tubing 106. In another example, the upper sensor 112*a* and the lower sensor 112*b* are positioned near the outer surface of the tubing 106, for example, on a standalone structure. The standalone structure can include movable platforms on which the upper sensor 112*a* and the lower sensor 112*b* are installed. The position of the movable platforms can be adjusted in order to adjust the positions of the upper sensors 112*a* and the lower sensor 112*b*. In yet another example, the upper sensor 112*a* and the lower sensor 112*b* are disposed within a porous housing (for example, a side-perforated housing). The porous housing defines an inner volume in which the upper sensor 112*a* and the lower sensor 112*b* are disposed. In some examples, the porous housing is a side-perforated pocket or housing 122 that houses the sensors 112*a*, 112*b* and the floating object 114.

In some embodiments, the upper sensor 112*a* is configured to turn on the ESP 110 when the fluid level in the annulus reaches a level at which the upper sensor 112*a* is installed. This operation ensures that the ESP 110 is operated only when there is sufficient hydrocarbon fluid in the annulus to be pumped. The lower sensor 112*b* is configured to turn off the ESP 110 when the fluid level in the annulus falls to a level at which the lower sensor 112*b* is installed. This operation ensures that the ESP 110 is turned off when the fluid level falls below a level at which the ESP 110 cannot pump the fluid without risk of burning.

In some embodiments, an object 114 that can float on the hydrocarbon fluid is disposed in the annulus. The object 114 is also referred to as a floating object or a floatable object. In these embodiments, the upper sensor 112*a* and the lower sensor 112*b* detect the fluid level when the floating object 114, which floats on the surface of the fluid, is detected by the upper sensor 112*a* or the lower sensor 112*b*. When the upper sensor 112*a* detects the floating object, the upper sensor 112*a* signals the ESP 110 to turn on. And when the lower sensor 112*b* detects the floating object, the lower sensor 112*b* signals the ESP 110 to turn off.

Figure 2A:
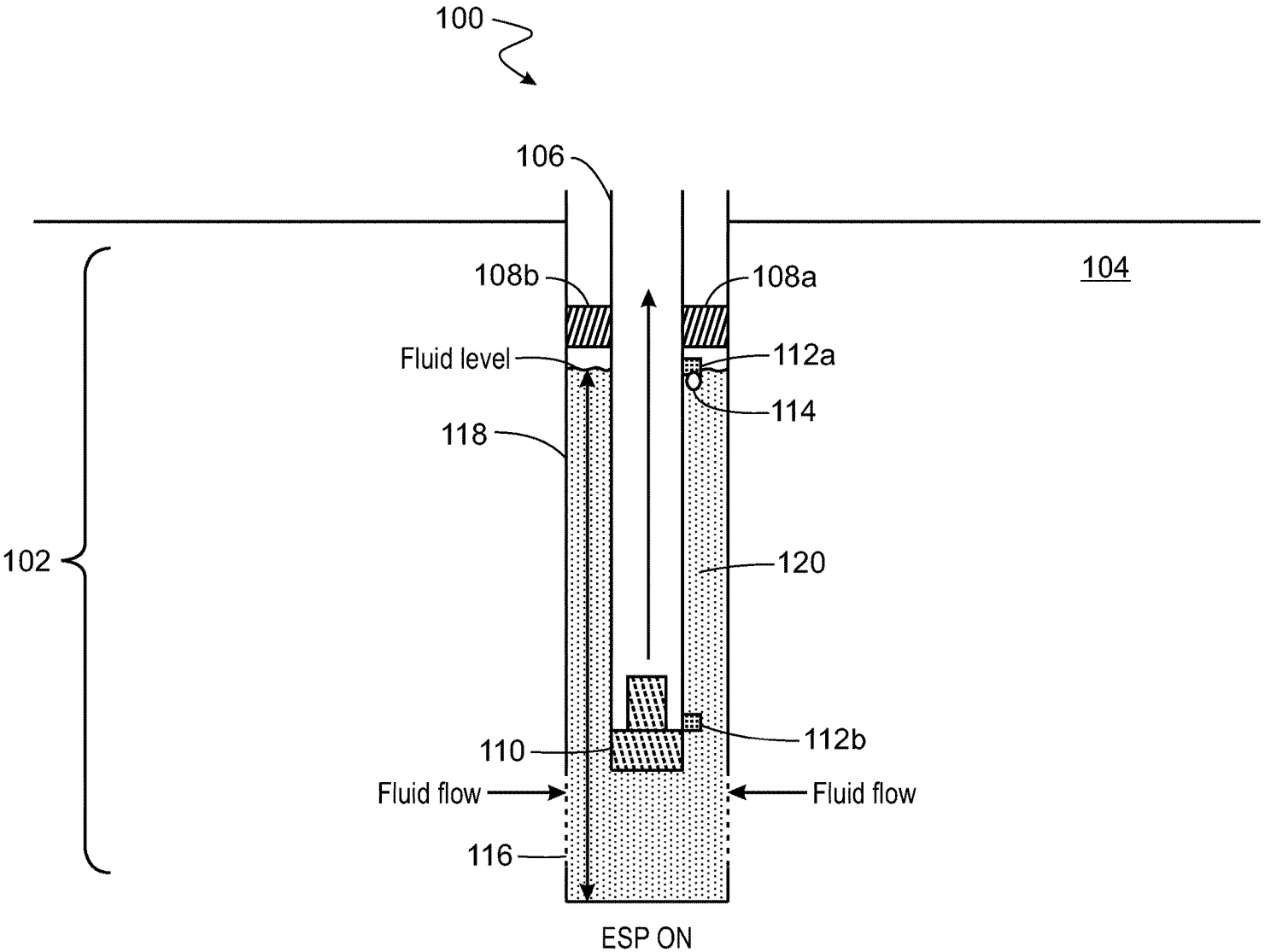
FIG. 2A and FIG. 2B are schematic illustrations of an example downhole pumping tool in operation, according to some implementations of the present disclosure.
Figure 2B:
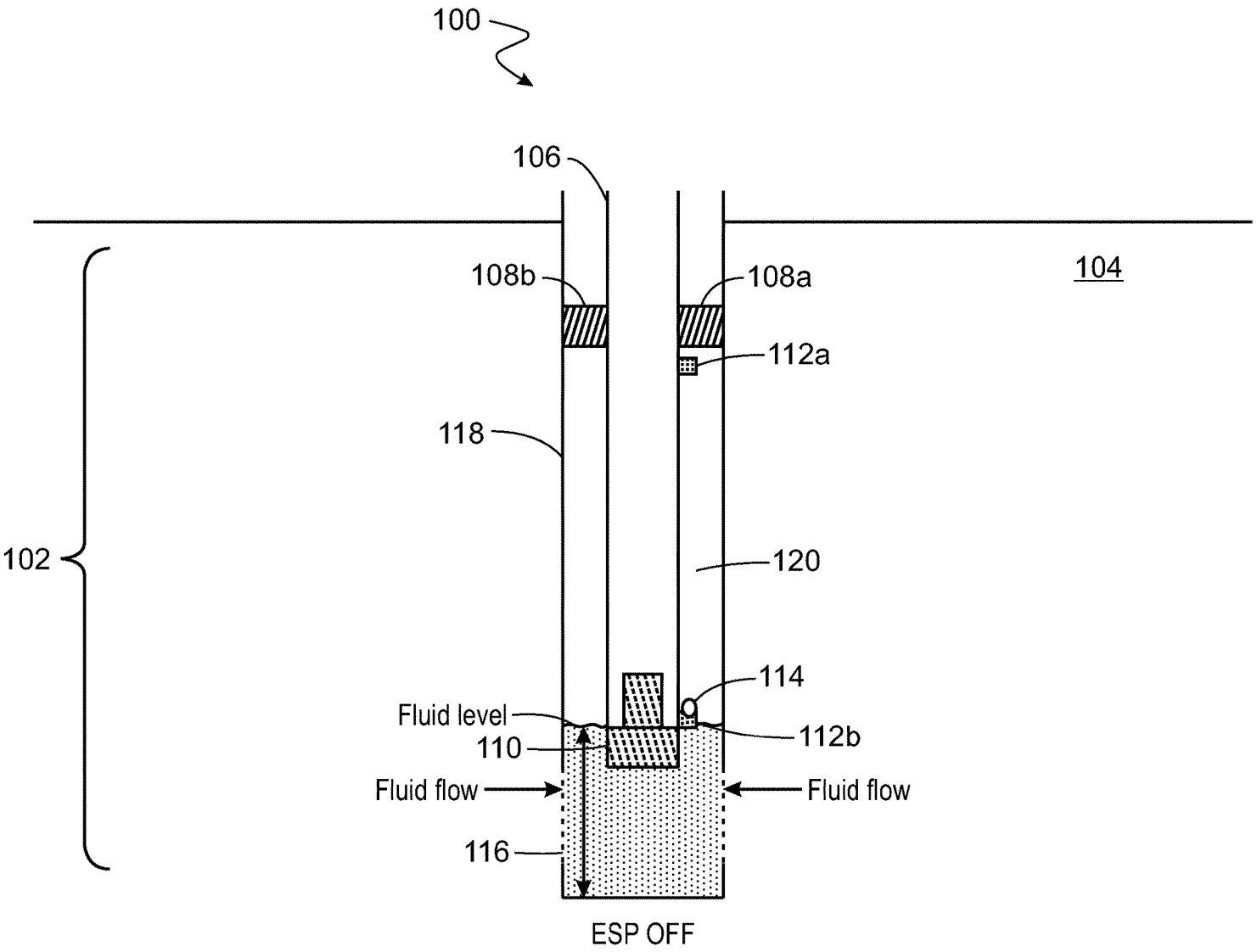

FIG. 2A and FIG. 2B are schematic illustrations of an example downhole pumping tool in operation, according to some implementations. Specifically, FIG. 2A illustrates a scenario 200 in which the ESP 110 is turned on and FIG. 2B illustrates a scenario 210 in which the ESP 110 is turned off. As shown in FIG. 2A, a fluid level in the annulus 120 has reached a level at which the upper sensor 112*a* is located. The upper sensor 112*a* determines that the fluid level has reached a first predetermined level by either detecting the surface of the fluid or by detecting the floating object 114. In response to the determination, the upper sensor 112*a* sends signals the ESP 110 to turn on. The ESP 110 turns on and pumps fluid from the annulus 120 into the tubing 106. Turning to FIG. 2B, after the ESP 110 pumps the fluid into the tubing 106, the fluid level in the annulus 120 begins to drop. As shown in FIG. 2B, the fluid level in the annulus 120 has reached a level at which the lower sensor 112*b* is located. The upper sensor 112*a* determines that the fluid level has reached a second predetermined level predetermined level by either detecting the surface of the fluid or by detecting the floating object 114. Once the lower sensor 112*b* determines that the fluid level in the annulus 120 has dropped to the second predetermined level, the lower sensor 112*b* signals the ESP 110 to turn off. As a result, the ESP 110 stops pumping fluid into the tubing 106.

Figure 3:
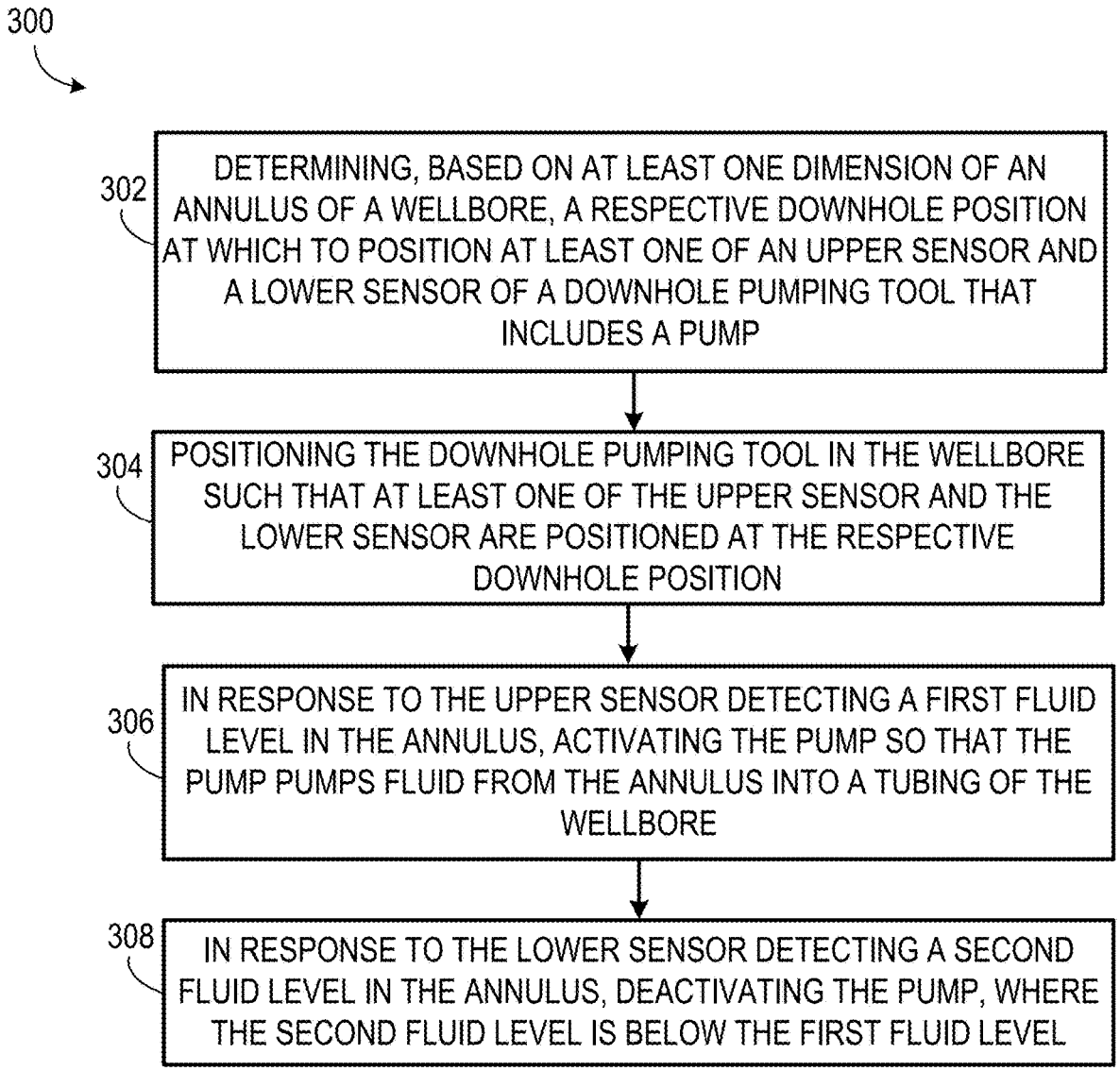
FIG. 3 is a flow chart illustrating an example method, according to some implementations of the present disclosure.

FIG. 3 illustrates a flowchart of an example method 300, according to some implementations. For clarity of presentation, the description that follows generally describes the method 300 in the context of the other figures in this description. For example, the method 300 can be performed by the computing system 400 shown in FIG. 4. However, it will be understood that the method 300 can be performed, for example, by any suitable system, environment, software, and hardware, or a combination of systems, environments, software, and hardware, as appropriate. In some implementations, various steps of the method 300 can be run in parallel, in combination, in loops, or in any order.

At step 302, the method 300 involves determining, based on at least one dimension of an annulus of a wellbore, a respective downhole position at which to position at least one of an upper sensor and a lower sensor of a downhole pumping tool that includes a pump. In an example, the at least one dimension of the annulus is used to determine a volume of the annulus, which, in turn, is used to determine an amount of fluid that can be stored in the annulus. Since the position of the upper sensor determines the fluid level at which the pump is turned on, the position of the upper sensor determines the amount of fluid in the annulus when the pump is turned on. Similarly, since the position of the lower sensor determines the fluid level at which the pump is turned off, the position of the lower sensor determines the amount of fluid in the annulus when the pump is turned off. The position of the lower sensor can be determined such that the amount of fluid that is in annulus when the pump is turned off is greater than a minimum amount of fluid that the pump needs to operate without burning. The minimum amount of fluid can be determined, for example, based on specifications of the pump.

In another example, the at least one dimension of the annulus is used to determine a distance between the upper sensor and the lower sensor. In this example, the distance is a function of at least one of a height of the annulus and a flow rate of fluid into the annulus. For instance, the lower the flow rate of fluid into the annulus the greater the distance between the upper sensor and the lower sensor in order to avoid frequently switching the pump on/off.

At step 304, the method 300 involves positioning the downhole pumping tool in the wellbore such that at least one of the upper sensor and the lower sensor are positioned at the respective downhole position. In an example, a downhole conveyance is used to position the downhole pumping tool in the wellbore. In particular, a computing system can control the downhole conveyance to position the downhole pumping tool such that the upper sensor and the lower sensor are disposed at the respective positions determined in step 302.

At step 306, the method 300 involves in response to the upper sensor detecting a first fluid level in the annulus, activating the pump so that the pump pumps fluid from the annulus into a tubing of the wellbore, where the tubing carries the fluid to the surface. At step 308, the method 300 involves in response to the lower sensor detecting a second fluid level in the annulus, deactivating the pump, where the second fluid level is below the first fluid level.

In some implementations, the method 300 further includes affixing a first packer to a first outer surface of the tubing and a casing of the wellbore, where the first packer longitudinally closer to the first sensor than the second sensor; and affixing a second packer to a second outer surface of the tubing and the casing, where the first and second outer surfaces are on horizontally opposite sides of the tubing, and where the tubing, the first packer, the second packer form the annulus when engaged with the casing. In some implementations, affixing the packers involves a computing device or a human operator controlling a robotic device or a downhole conveyance to affix the packers to the outer surface of the tubing and the casing of the wellbore.

In some implementations, the upper and lower sensors are located between a first plurality of perforations in the casing and the first packer.

In some implementations, the first packer and the second packer are inflatable packers.

In some implementations, the tubing is a production string.

In some implementations, the downhole pumping tool further includes: a porous housing defining an inner volume; and a floatable object that floats on the fluid, wherein the floatable object, the first sensor, and the second sensor are located within the inner volume, and wherein the first sensor and the second sensor are configured to detect the floatable object.

In some implementations, the pump is an electric submersible pump.

Figure 4:
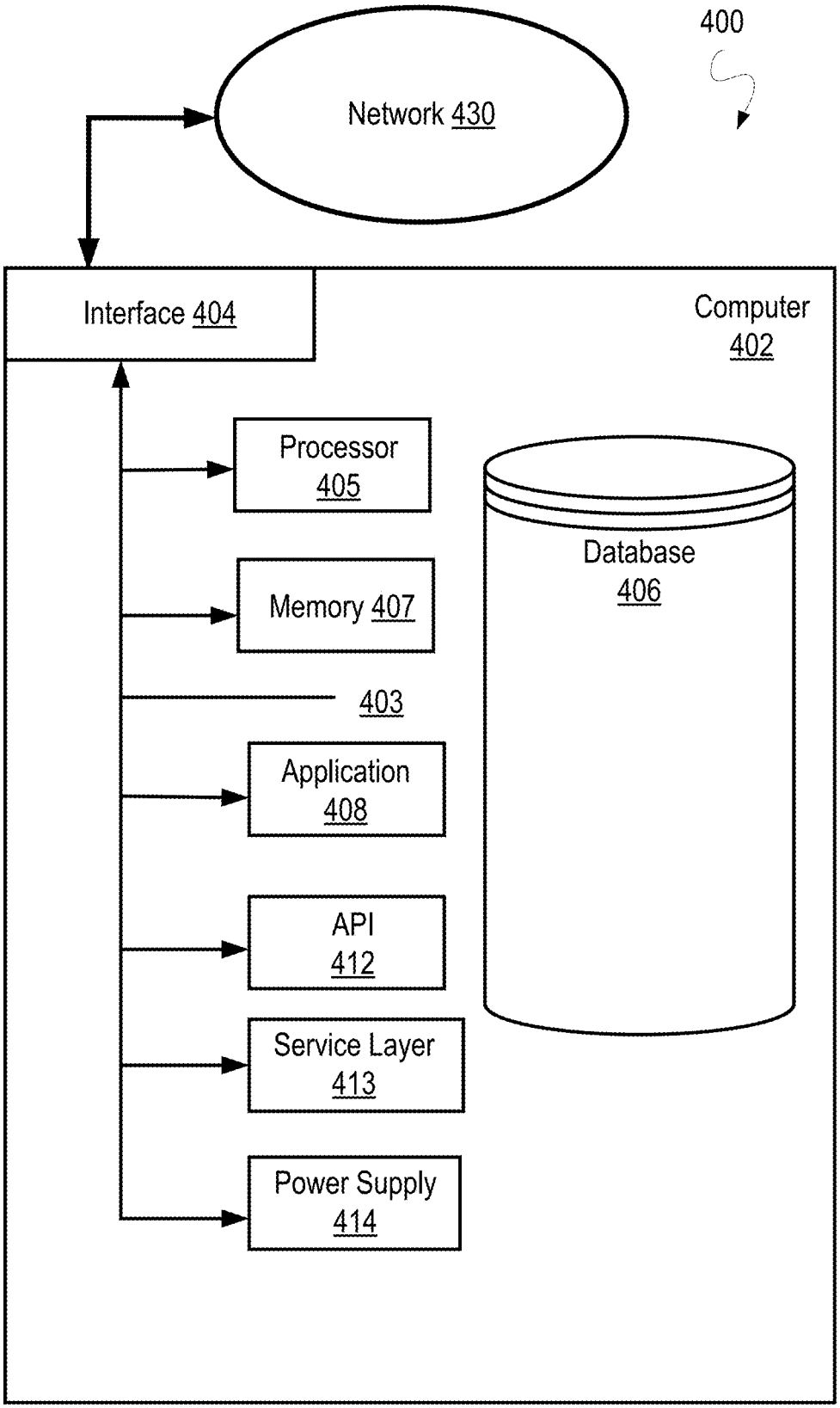
FIG. 4 is a block diagram of an example computer system, according to some implementations of the present disclosure Like reference symbols in the various drawings indicate like elements.

FIG. 4 is a block diagram of an example computer system 400 that can be used to provide computational functionalities associated with described algorithms, methods, functions, processes, flows, and procedures described in the present disclosure, according to some implementations of the present disclosure. In some implementations, a controller of the wellbore system 100 or the downhole pumping tool can be the computer system 400 or include the computer system 400. In some implementations, the controller can communicate with the computer system 400.

The illustrated computer 402 is intended to encompass any computing device such as a server, a desktop computer, an embedded computer, a laptop/notebook computer, a wireless data port, a smart phone, a personal data assistant (PDA), a tablet computing device, or one or more processors within these devices, including physical instances, virtual instances, or both. The computer 402 can include input devices such as keypads, keyboards, and touch screens that can accept user information. Also, the computer 402 can include output devices that can convey information associated with the operation of the computer 402. The information can include digital data, visual data, audio information, or a combination of information. The information can be presented in a graphical user interface (UI) (or GUI). In some implementations, the inputs and outputs include display ports (such as DVI-I+2x display ports), USB 3.0, GbE ports, isolated DI/O, SATA-III (6.0 Gb/s) ports, mPCIe slots, a combination of these, or other ports. In instances of an edge gateway, the computer 402 can include a Smart Embedded Management Agent (SEMA), such as a built-in ADLINK SEMA 2.2, and a video sync technology, such as Quick Sync Video technology supported by ADLINK MSDK+. In some examples, the computer 402 can include the MXE-5400 Series processor-based fanless embedded computer by ADLINK, though the computer 402 can take other forms or include other components.

The computer 402 can serve in a role as a client, a network component, a server, a database, a persistency, or components of a computer system for performing the subject matter described in the present disclosure. The illustrated computer 402 is communicably coupled with a network 430. In some implementations, one or more components of the computer 402 can be configured to operate within different environments, including cloud-computing-based environments, local environments, global environments, and combinations of environments.

At a high level, the computer 402 is an electronic computing device operable to receive, transmit, process, store, and manage data and information associated with the described subject matter. According to some implementations, the computer 402 can also include, or be communicably coupled with, an application server, an email server, a web server, a caching server, a streaming data server, or a combination of servers.

The computer 402 can receive requests over network 430 from a client application (for example, executing on another computer 402). The computer 402 can respond to the received requests by processing the received requests using software applications. Requests can also be sent to the computer 402 from internal users (for example, from a command console), external (or third) parties, automated applications, entities, individuals, systems, and computers.

Each of the components of the computer 402 can communicate using a system bus. In some implementations, any or all of the components of the computer 402, including hardware or software components, can interface with each other or the interface 404 (or a combination of both), over the system bus. Interfaces can use an application programming interface (API), a service layer, or a combination of the API and service layer. The API can include specifications for routines, data structures, and object classes. The API can be either computer-language independent or dependent. The API can refer to a complete interface, a single function, or a set of APIs.

The service layer can provide software services to the computer 402 and other components (whether illustrated or not) that are communicably coupled to the computer 402. The functionality of the computer 402 can be accessible for all service consumers using this service layer. Software services, such as those provided by the service layer, can provide reusable, defined functionalities through a defined interface. For example, the interface can be software written in JAVA, C++, or a language providing data in extensible markup language (XML) format. While illustrated as an integrated component of the computer 402, in alternative implementations, the API or the service layer can be standalone components in relation to other components of the computer 402 and other components communicably coupled to the computer 402. Moreover, any or all parts of the API or the service layer can be implemented as child or submodules of another software module, enterprise application, or hardware module without departing from the scope of the present disclosure.

The computer 402 can include an interface 404. Although illustrated as a single interface 404 in FIG. 4, two or more interfaces 404 can be used according to particular needs, desires, or particular implementations of the computer 402 and the described functionality. The interface 404 can be used by the computer 402 for communicating with other systems that are connected to the network 430 (whether illustrated or not) in a distributed environment. Generally, the interface 404 can include, or be implemented using, logic encoded in software or hardware (or a combination of software and hardware) operable to communicate with the network 430. More specifically, the interface 404 can include software supporting one or more communication protocols associated with communications. As such, the network 430 or the interface's hardware can be operable to communicate physical signals within and outside of the illustrated computer 402.

The computer 402 includes a processor 405. Although illustrated as a single processor 405 in FIG. 4, two or more processors 405 can be used according to particular needs, desires, or particular implementations of the computer 402 and the described functionality. Generally, the processor 405 can execute instructions and can manipulate data to perform the operations of the computer 402, including operations using algorithms, methods, functions, processes, flows, and procedures as described in the present disclosure.

The computer 402 can also include a database 406 that can hold data for the computer 402 and other components connected to the network 430 (whether illustrated or not). For example, database 406 can be an in-memory, conventional, or a database storing data consistent with the present disclosure. In some implementations, database 406 can be a combination of two or more different database types (for example, hybrid in-memory and conventional databases) according to particular needs, desires, or particular implementations of the computer 402 and the described functionality. Although illustrated as a single database 406 in FIG. 4, two or more databases (of the same, different, or combination of types) can be used according to particular needs, desires, or particular implementations of the computer 402 and the described functionality. While database 406 is illustrated as an internal component of the computer 402, in alternative implementations, database 406 can be external to the computer 402.

The computer 402 also includes a memory 407 that can hold data for the computer 402 or a combination of components connected to the network 430 (whether illustrated or not). Memory 407 can store any data consistent with the present disclosure. In some implementations, memory 407 can be a combination of two or more different types of memory (for example, a combination of semiconductor and magnetic storage) according to particular needs, desires, or particular implementations of the computer 402 and the described functionality. Although illustrated as a single memory 407 in FIG. 4, two or more memories 407 (of the same, different, or combination of types) can be used according to particular needs, desires, or particular implementations of the computer 402 and the described functionality. While memory 407 is illustrated as an internal component of the computer 402, in alternative implementations, memory 407 can be external to the computer 402.

An application can be an algorithmic software engine providing functionality according to particular needs, desires, or particular implementations of the computer 402 and the described functionality. For example, an application can serve as one or more components, modules, or applications. Multiple applications can be implemented on the computer 402. Each application can be internal or external to the computer 402.

The computer 402 can also include a power supply 414. The power supply 414 can include a rechargeable or non-rechargeable battery that can be configured to be either user- or non-user-replaceable. In some implementations, the power supply 414 can include power-conversion and management circuits, including recharging, standby, and power management functionalities. In some implementations, the power-supply 414 can include a power plug to allow the computer 402 to be plugged into a wall socket or a power source to, for example, power the computer 402 or recharge a rechargeable battery.

There can be any number of computers 402 associated with, or external to, a computer system including computer 402, with each computer 402 communicating over network 430. Further, the terms "client," "user," and other appropriate terminology can be used interchangeably, as appropriate, without departing from the scope of the present disclosure. Moreover, the present disclosure contemplates that many users can use one computer 402 and one user can use multiple computers 402.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example, Linux, Unix, Windows, Mac OS, Android, or iOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks and optical memory devices and technologies including, for example, digital video disc (DVD), CD ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

What is claimed is:

1. An apparatus comprising:

a first packer affixed between a first outer surface of a tubing and a casing of a wellbore in a subterranean formation;

a second packer affixed between a second outer surface of the tubing and the casing, wherein the first outer surface and the second outer surface are on horizontally opposite sides of the tubing, and wherein the tubing, the first packer, the second packer form an annulus when engaged with the casing;

a pump that defines an inlet from the annulus into the tubing; and a first sensor and a second sensor affixed to the first outer surface of the tubing, the second sensor longitudinally separated further away from the first packer than the first sensor, wherein the first sensor is configured to activate the pump when a fluid in the annulus reaches a first level, and wherein the second sensor is configured to deactivate the pump when the fluid is less than or equal to a second level.

2. The apparatus of claim 1, wherein the first packer is longitudinally separated from a first plurality of perforations in the casing, wherein the second packer is longitudinally separated from a second plurality of perforations in the casing of the wellbore, and wherein the fluid flows from the subterranean formation into the annulus through the first and second plurality of perforations.

3. The apparatus of claim 2, the first and second sensors are located between the first plurality of perforations and the first packer.

4. The apparatus of claim 1, wherein the tubing is a production string.

5. The apparatus of claim 1, wherein the first packer and the second packer are inflatable packers.

6. The apparatus of claim 1, further comprising:

a porous housing defining an inner volume; and a floatable object that floats on the fluid, wherein the floatable object, the first sensor, and the second sensor are located within the inner volume, and wherein the first sensor and the second sensor are configured to detect the floatable object.

7. The apparatus of claim 1, wherein the pump is an electric submersible pump.

8. The apparatus of claim 1, wherein the subterranean formation is a low productivity index reservoir.

9. A method, comprising:

determining, based on at least one dimension of an annulus of a wellbore, a respective downhole position at which to position at least one of an upper sensor and a lower sensor of a downhole pumping tool that includes a pump;

positioning the downhole pumping tool in the wellbore such that at least one of the upper sensor and the lower sensor are positioned at the respective downhole position;

in response to the upper sensor detecting a first fluid level in the annulus, activating the pump so that the pump pumps fluid from the annulus into a tubing of the wellbore, wherein the tubing carries the fluid to the surface; and in response to the lower sensor detecting a second fluid level in the annulus, deactivating the pump, wherein the second fluid level is below the first fluid level.

10. The method of claim 9, further comprising:

affixing a first packer to a first outer surface of the tubing and a casing of the wellbore, wherein the first packer longitudinally closer to the first sensor than the second sensor; and affixing a second packer to a second outer surface of the tubing and the casing, wherein the first and second outer surfaces are on horizontally opposite sides of the tubing, and wherein the tubing, the first packer, the second packer form the annulus when engaged with the casing.

11. The method of claim 10, the upper and lower sensors are located between a first plurality of perforations in the casing and the first packer.

12. The method of claim 10, wherein the first packer and the second packer are inflatable packers.

13. The method of claim 9, wherein the tubing is a production string.

14. The method of claim 9, wherein the downhole pumping tool further comprises:

a porous housing defining an inner volume; and a floatable object that floats on the fluid, wherein the floatable object, the first sensor, and the second sensor are located within the inner volume, and wherein the first sensor and the second sensor are configured to detect the floatable object.

15. The method of claim 9, wherein the pump is an electric submersible pump.

16. A system, comprising:

a first packer affixed between a first outer surface of a tubing and a casing of a wellbore in a subterranean formation;

a second packer affixed between a second outer surface of the tubing and the casing, wherein the first outer surface and the second outer surface are on horizontally opposite sides of the tubing, and wherein the tubing, the first packer, the second packer form an annulus when engaged with the casing;

a pump that defines an inlet from the annulus into the tubing; and a first sensor and a second sensor affixed to the first outer surface of the tubing, the second sensor longitudinally separated further away from the first packer than the first sensor;

one or more processors; and a non-transitory computer-readable storage medium coupled to the one or more processors and storing programming instructions for execution by the one or more processors, the programming instructions instructing the one or more processors to perform operations comprising:

in response to the first sensor detecting a first fluid level in the annulus, activating the pump so that the pump pumps fluid from the annulus into a tubing of the wellbore, wherein the tubing carries the fluid to the surface; and in response to the second sensor detecting a second fluid level in the annulus, deactivating the pump, wherein the second fluid level is below the first fluid level.

17. The system of claim 16, wherein the first packer is longitudinally separated from a first plurality of perforations in the casing, wherein the second packer is longitudinally separated from a second plurality of perforations in the casing of the wellbore, and wherein the fluid flows from the subterranean formation into the annulus through the first and second plurality of perforations.

18. The system of claim 17, the first and second sensors are located between the first plurality of perforations and the first packer.

19. The system of claim 16, wherein the first packer and the second packer are inflatable packers.

20. The system of claim 16, further comprising:

a porous housing defining an inner volume; and a floatable object that floats on the fluid, wherein the floatable object, the first sensor, and the second sensor are located within the inner volume, and wherein the first sensor and the second sensor are configured to detect the floatable object.

* * * * *